United States Patent [19]

Reckziegel

[11] Patent Number: 4,984,949

[45] Date of Patent: Jan. 15, 1991

[54] CONTINUOUS BOOKBINDING PROCESS USING A MOISTURE CURABLE POLYURETHANE ADHESIVE

[75] Inventor: Erich Reckziegel, Duesseldorf, Fed. Rep. of Germany

[73] Assignee: Henkel Kommanditgesellschaft auf Aktien, Duesseldorf, Fed. Rep. of Germany

[21] Appl. No.: 355,895

[22] Filed: May 19, 1989

Related U.S. Application Data

[63] Continuation of Ser. No. 74,429, filed as PCT EP86/00616 on Oct. 25, 1986, published as WO87/02624 on May 7, 1987, abandoned.

[30] Foreign Application Priority Data

Nov. 2, 1985 [DE] Fed. Rep. of Germany ..... 3538897

[51] Int. Cl.[5] ..... B42C 9/00

[52] U.S. Cl. ..... 412/8; 156/216; 156/291; 156/331.4; 156/908; 428/425.1

[58] Field of Search ..... 156/216, 291, 319, 331.4, 156/908, 479; 412/4, 5, 6, 8; 428/425.1

[56] References Cited

U.S. PATENT DOCUMENTS

| | | | |
|---|---|---|---|
| 3,223,436 | 12/1965 | Becker | 156/908 |
| 3,716,434 | 2/1973 | Cook et al. | 156/291 |
| 3,788,921 | 1/1974 | Polit et al. | 156/216 |
| 4,129,471 | 12/1978 | Rome | 156/216 |
| 4,184,218 | 1/1980 | Hawkes | 156/908 |
| 4,244,069 | 1/1981 | Hale | 156/908 |
| 4,282,055 | 8/1981 | Bosse et al. | 156/216 |
| 4,307,004 | 12/1981 | Schuhmacher et al. | 156/291 |
| 4,496,617 | 1/1985 | Parker | 156/908 |
| 4,539,345 | 9/1985 | Hansen | 156/331.4 |
| 4,565,477 | 1/1986 | Axelrod | 412/5 |
| 4,687,533 | 8/1987 | Rizk et al. | 156/331.4 |

FOREIGN PATENT DOCUMENTS

| | | | |
|---|---|---|---|
| 2515251 | 10/1976 | Fed. Rep. of Germany | 412/4 |

*Primary Examiner*—Michael W. Ball
*Assistant Examiner*—Michele K. Yoder
*Attorney, Agent, or Firm*—Ernest G. Szoke; Wayne C. Jaeschke; Daniel S. Ortiz

[57] ABSTRACT

A process for book binding in which a block of pages, one of whose sides constitutes a book spine, is adhered to a book cover through the applicaiton of a polyurethane hot melt adhesive to the book cover and not to the spine, together with parallel side strips of adhesive.

17 Claims, 3 Drawing Sheets

CONTINUOUS BOOKBINDING PROCESS USING A MOISTURE CURABLE POLYURETHANE ADHESIVE

This application is a continuation of application Ser. No. 07/074,429, filed as PCT EP86/00616 on Oct. 25, 1976, published as W087/02624 on May 7, 1987 now abandoned.

BACKGROUND OF THE INVENTION

1. Field of the Invention

The invention pertains to an adhesive application process in book manufacturing during the joining of the book block and the cover using a PUR melt adhesive system (PUR=polyurethane) that undergoes cross-linking in the presence of moisture. The term "book manufacture" in the present connection, aside from the manufacturing of books in the true sense, is also defined to include the manufacture of other graphic products, such as journals and catalogs. The terms "book block", "book spine" and the like used in the following have a corresponding general significance.

2. Statement of Related Art

For the adhesive binding of graphic products on table-type devices as well as semiautomatic or completely automatic adhesive binding machines, the adhesive is applied via roller application systems, directly to the book spine. For this purpose, open glue buckets are used. Attempts have already been made to likewise apply the adhesive directly to the spine of the book using nozzles adapted to the shape of the spine. However, this procedure failed due to the fact that the marginal leaves on the cut edge were unable to be reliably or completely covered with adhesive. Especially in the case of high-volume papers, in which the degree of deformation is particularly high as a result of the pressure of the grippers required to hold the book, problems often occur.

In practice, dispersion adhesives, glutin adhesives and melt adhesives are used for adhesion. However, the application range of these adhesive groups is limited, since the papers which are difficult to join depending on the adhesive type are no longer bonded with a strength sufficient for the stress of utilization. For example, volatile components of printing ink that may have been applied to the contents page or even the ink itself or constituents of the surface coating from the cover may migrate into the adhesive and reduce its strength. In addition, there is limited flexibility at low temperatures of less than −20° C. as well as a decrease in strength at higher temperatures of more than 80° C.

The problems in the systems mentioned, operating with single-layer or multi-layer application, can be largely eliminated in and of themselves by using single-component or two-component PUR melt adhesives. However, whereas two-component systems can still be processed and mastered well with the above-mentioned roller application systems, this is no longer true for the PUR melt adhesive systems which undergo cross-linking in the presence of moisture. To be sure, an improvement can be achieved by means of substantially smaller, largely encapsulated application systems, but the fundamental risk of undesired cross-linking remains. In the case of longer work intervals, which can occur in the case of format changes or machine change-over, or in the case of problems occurring with machines located earlier in the process stream, the application system must therefore be cleaned, or the risk of cross-linking of the adhesive still present in the application system must be taken into consideration. Since completely cross-linked PUR melt adhesives are not soluble or fusible, cleaning can only be accomplished mechanically, with a correspondingly high expenditure of time.

From package gluing, technology adhesive application systems are already known from German Published Application No. 1,274,864 and German Preliminary Published Application No. 1,922,056 which, equipped with one or several nozzles, can continuously or discontinuously apply adhesive in a manner limited in terms of width and length to a substrate, for example the closing strip of a cardboard carton. Dispersion adhesives as well as animal glues and melt adhesives are suitable for this application system.

BRIEF DESCRIPTION OF THE INVENTION

The invention is based on the task of creating a process with which adhesives sensitive to external influences, such as oxygen from the air and moisture, can be processed without problems in book manufacture for spine gluing as well as side gluing the joining surfaces of the book block and the cover. In particular the process is to be designed such that PUR melt adhesives (hot melts) that cross-link in the presence of moisture can be applied economically and without problems. The solution in accordance with the invention for the adhesive application process for joining the book block and the cover consists of the fact that the adhesive is applied to the cover in a width exceeding the thickness of the spine of the book on both sides by at least 0.5 mm.

Since, in contrast to the previously customary procedure, the PUR melt adhesive is not applied directly to the book spine, but instead to the cover, the application width can be adjusted so as to exceed the thickness of the book block on both sides, specifically by 0.5 to 20 mm, in such a way that the marginal sheets are always completely covered by the adhesive with absolute reproducibility.

In the case of very light papers, the PUR melt adhesive can be applied at the same thickness over the total width, since relatively thin layer thicknesses in the range of 0.1 to 0.2 mm are to be used, so that the increase occurring in the area of the spine as a result of the side gluing causes little problem. The extent of the problem produced decreases with increasing thickness of the book block.

For thicker, high-volume papers, in accordance with a further embodiment of the invention, either slit nozzles or multi-hole nozzles are used as the application head. A differentiation in the application thickness in the area of the spine and side gluing can be achieved in the case of the slit nozzle as a result of tapered front surfaces, and in the case of the multi-hole nozzle, as a result of smaller nozzle hole diameters in the area of the side gluing. In this connection it is possible even in the case of thicker adhesive application to the book spine to obtain a thin side gluing and to avoid the undesirable increase in the area of the spine. The ratio of the adhesive thickness of the side gluing strips (see element 7 in the drawing) to that of the spine gluing center portion (see element 6 in the drawing) may be pre-specified corresponding to the thickness of the book (block) and the pages. The nozzles for the side gluing can also be made separate from the spine gluing, wherein then the choice is available of applying the side gluing to the cover or to the book spine. Obviously, this alternative also exists for the case of slit nozzles.

It is also advantageous to apply a water mist or water vapor to the adhesive application site. In this manner, especially in the case of thicker adhesive layers, the wetting necessary for cross-linking is carried out more effectively and rapidly than it would be through the inherent moisture of the paper or the moisture from the ambient air. It is advisable to apply the water mist or the water vapor between the adhesive application and the application of the cover.

An additional essential advantage of the invention consists of the fact that in the case of a limited-time shutdown of the adhesive application system, no appreciable change of the adhesive in the nozzle, closed off from external influences, will take place. In the case of more prolonged interruption and at the end of the working interval, the system can be completely closed off without difficulty by removing the nozzle and closing off the supply. The effort necessary for cleaning the nozzle head is naturally small compared to efforts previously employed for cleaning an entire roller-equipped application system.

BRIEF DESCRIPTION OF THE DRAWING

On the basis of the schematic representation of exemplified embodiments, details of the invention will be explained. These show the following:

FIG. 3 an adhesive application to the book block parallel and adjacent to its spine.

DETAILED DESCRIPTION OF THE INVENTION

Figure 1:
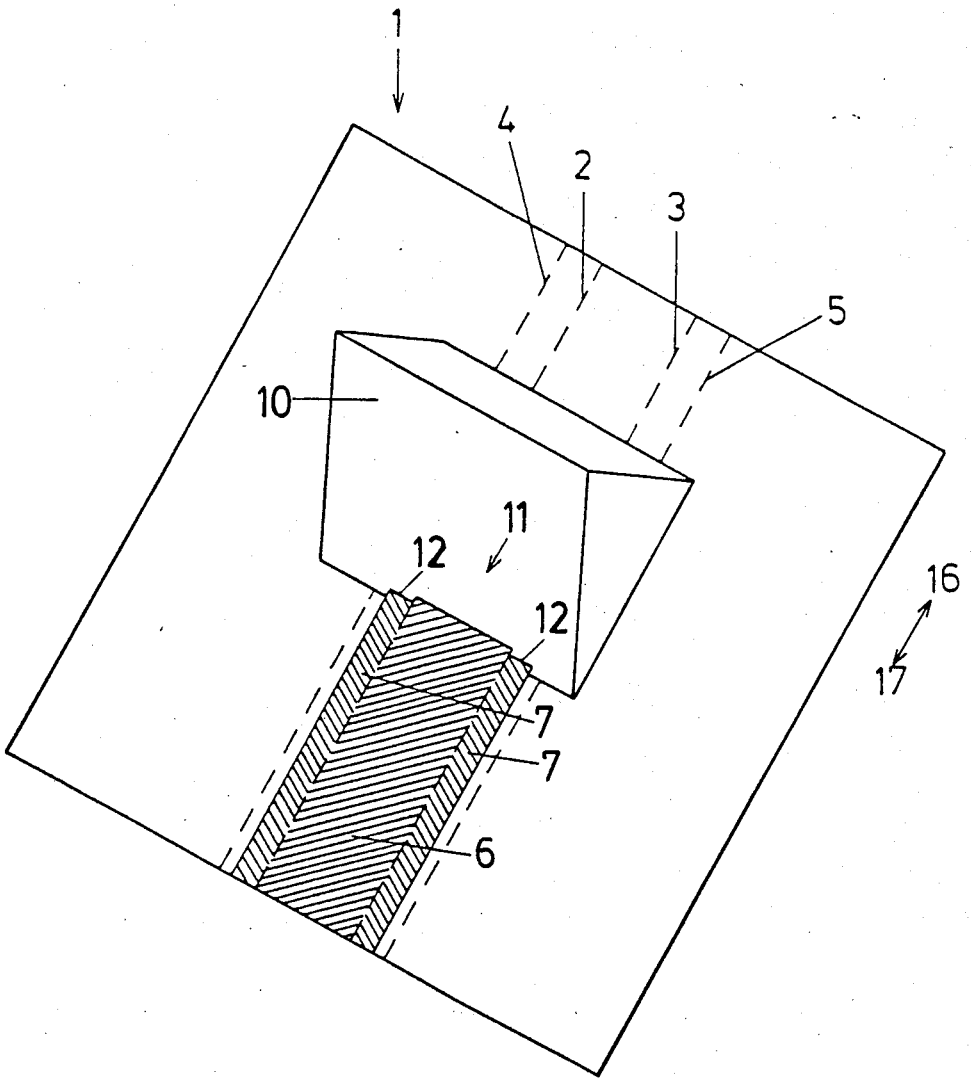
FIG. 1 an adhesive application system with a slit nozzle.
Figure 2:
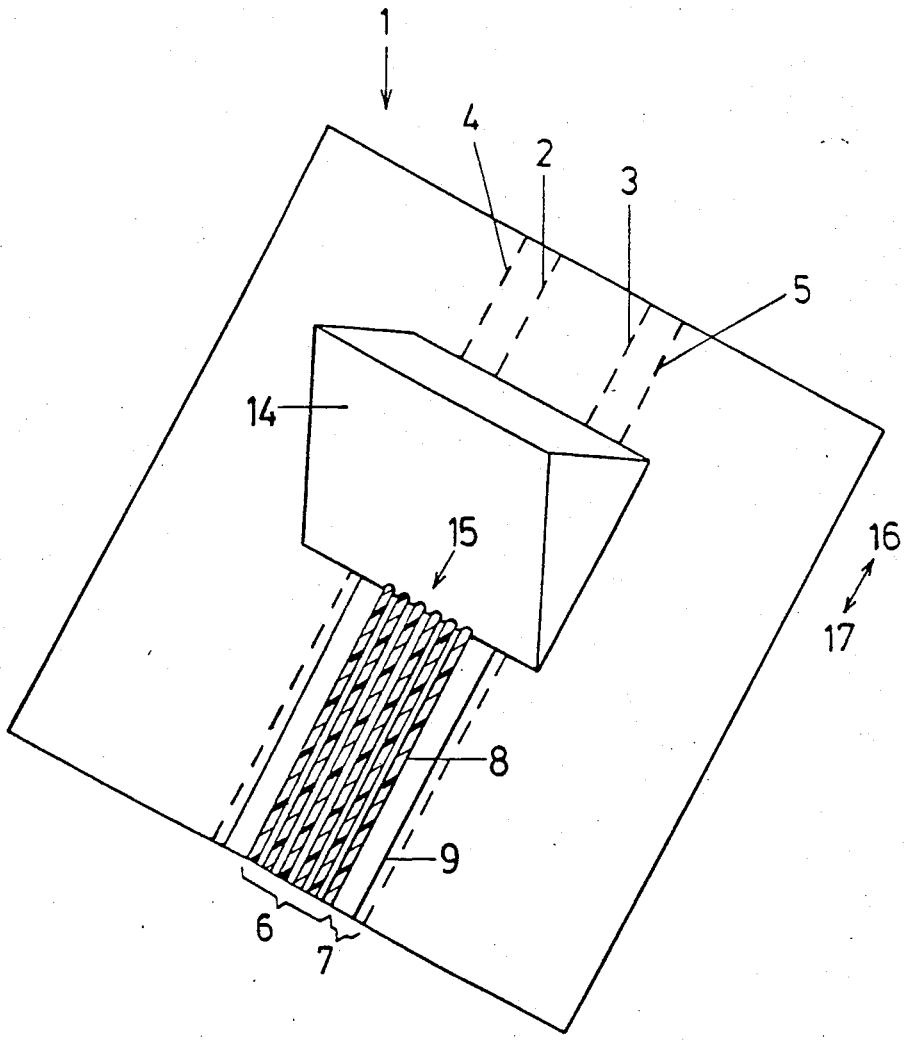
FIGS. 2 and 3 an application system with a multi-hole nozzle.
Figure 3:
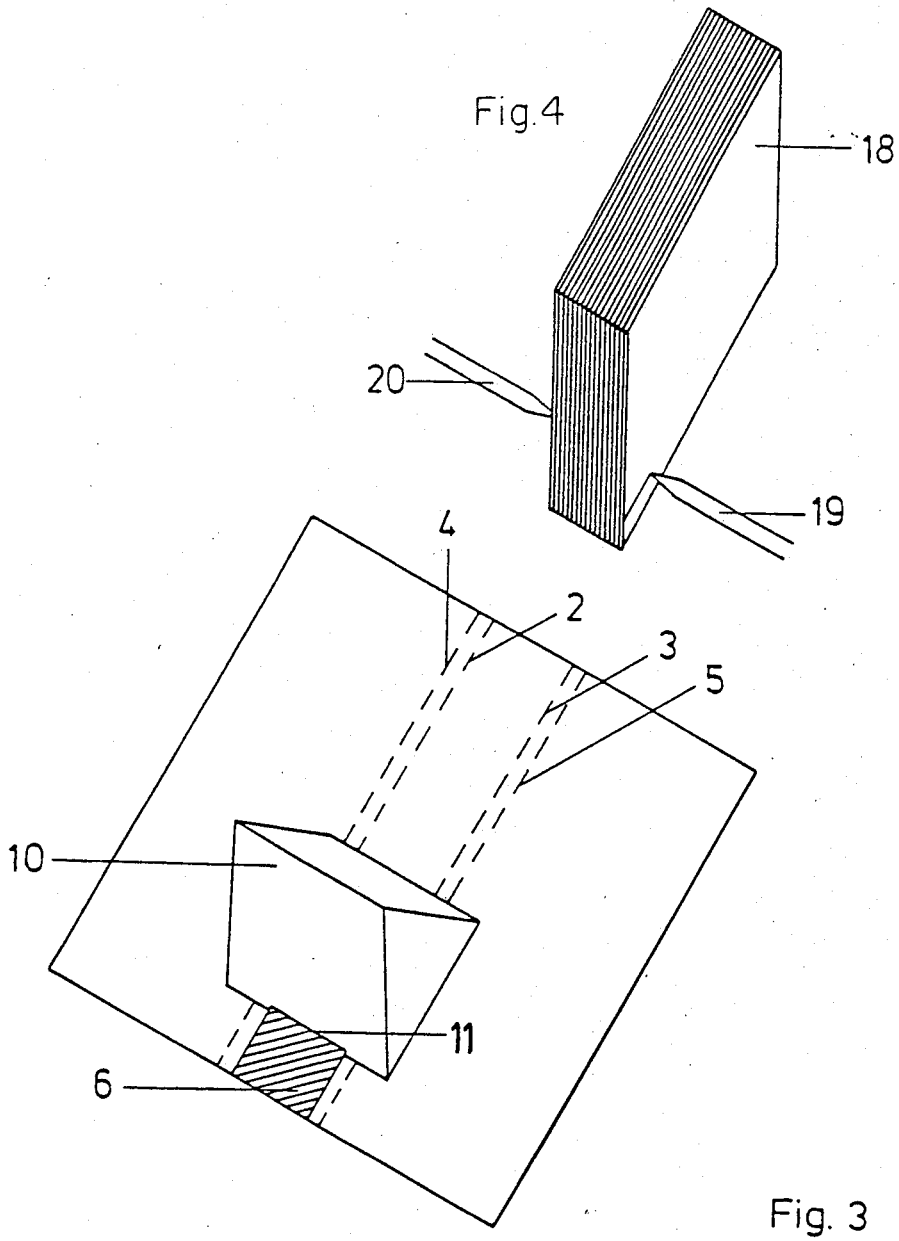

In FIGS. 1 and 2, a cover provided for gluing on the back of a book block is designated as a whole by 1. The cover 1 has an internal pair of scorings 2, 3 and an external pair of scorings 4, 5. Between the internal scorings 2 and 3, the spine gluing 6 is provided, wherein a side gluing can be applied in the area between the scorings 2 and 4 and/or 3 and 6 respectively. The spine gluing 6 and the side gluing 7 can be provided superficially as in FIG. 1 or as separate adhesive strips 8 and 9, as in FIG. 2.

In FIG. 1, a nozzle head 10 with slit nozzles designated altogether by 11 is provided for the application of the spine gluing and side gluing, 6 and 7. The slit nozzle 11 can operate in the contact process or can apply the adhesive from a nozzle just barely not touching the paper of the cover, i.e., over a short distance, to the respective surface 6 or 7. In the exemplified embodiment a slit nozzle 11 is provided which on the edges provided for the side gluing has a step 12 in such a manner that the central part 13 of the slit nozzle 11 supplies a thicker adhesive coating than the marginal part in the area of the step 12. Basically, however, a slit nozzle 11 with a uniform slit thickness overall can also be used. This should then be of such a width that the width of the book spine to be covered with adhesive is exceeded by the spine gluing 6 on both sides by at least 0.5 mm, especially up to 2 mm. As a result, even in the absence of side gluing, perfect gluing of the marginal leaves as well is also guaranteed.

The exemplified embodiment according to FIG. 2 shows a nozzle head 14 with a multi-hole nozzle, designated as a whole by 15. Amounts of 0.5 to 5 mm can be provided as distances between the holes in the multi-hole nozzle 15, both in the area of the spine gluing 6 and in the area of the side gluing 7. In this case as well, a spine gluing 6 is advantageously applied—even in the absence of an actual side gluing—which is about 0.5 to 2 mm wider than the book spine to be glued, in order to reliably grasp the respective end pages.

If the multi-hole nozzle 15 of the nozzle head 14 according to FIG. 2 is designed for spine gluing 6 as well as for side gluing 7, it may be advantageous to select the nozzle hole diameter in the area of the side gluing 7, corresponding to the desired difference in the adhesive application thickness, smaller than in the area of the spine gluing 6. In the exemplified embodiment, the side adhesive strips 9 in the area of the side gluing 7 are distinctly narrower than the adhesive strips 8 in the spine area of the spine gluing 6.

In the exemplified embodiment according to FIGS. 1 and 2, during operation, either the nozzle head 10 or 14 is moved in the direction of the arrow 16 relative to the cover 1, or the cover 1 is moved in the direction of the arrow 17 relative to the nozzle head 10 or 14.

If the side gluing is to be applied not to the cover, but rather directly to the book block 18, conventional slit nozzles or perforated nozzles 19, 20 are to be used for this purpose, as shown in FIG. 4. Roller application systems are not advisable even in this case if moisture-cross-linking PUR adhesive systems are used.

I claim:

1. A continuous process for book binding in which a block of pages, one of whose edges constitutes a book spine, is adhered to a book cover, consisting essentially of: (A) applying a zone of a hot melt adhesive consisting essentially of a polyurethane resin which cures by cross-linking in the presence of moisture, to a center portion of said book cover which will contact said spine in an amount sufficient to adhere the cover to the spine and in two parallel strips on either side and adjacent to the center portion of the book cover, said strips being at least 0.5 mm wide; and (B) bringing into and maintaining said block and book cover in intimate contact while the hot melt adhesive is in a bondable condition and permitting said polyurethane resin to cure, in the presence of moisture, until adhered to each other.

2. The process of 1 wherein the layer of adhesive of said center portion and the layers of adhesive of said strips are of the same thickness.

3. The process of claim 1 wherein the layer of adhesive applied to said center portion is thicker than the layers of adhesive applied to said strips.

4. The process of claim 1 wherein said glue is applied in a thickness of 0.1 to 0.2 mm.

5. The process of claim 1 wherein a water mist or water vapor is applied to the site of said adhesive.

6. The process of claim 1 wherein a water mist or water vapor is applied to the site of said adhesive between the steps of applying said adhesive and bringing said block and book cover into contact.

7. The process of claim 1 wherein said adhesive is applied with the aid of a slit nozzle or a multi-hole nozzle.

8. The process of claim 1 wherein said adhesive is applied to said center portion with one slit nozzle, and to said side strips with other, separate, slit nozzles.

9. The process of claim 1 wherein said adhesive is applied to said center portion and side strips with a multi-hole nozzle whose holes are in a line 0.5 to 5 mm apart.

10. The process of claim 9 wherein said adhesive is applied to said side strips through holes which are smaller in diameter than the holes used to apply the adhesive to the center portion, which are of equal size.

11. The process of claim 1 wherein: said parallel side strips are applied to said book cover; said adhesive application is by means of a nozzle with one slit for the center portion and separate slits for the side strips; and water mist or water vapor is applied to the site of said adhesive between the steps of applying said adhesive and bringing said block and said book cover into contact.

12. The process of claim 1 wherein: said parallel side strips are applied to said book cover; said adhesive application is by means of a multi-hole nozzle whose holes are in a line 0.5 to 5 mm apart; and water mist or water vapor is applied to the site of said adhesive between the steps of applying said adhesive and bringing said block and said book cover into contact.

13. The process of claim 12 wherein said sidestrips are applied through holes of smaller diameter than the holes used to apply the adhesive to the center portion, which are of equal size.

14. A continuous process for book binding in which a block of pages, one of whose edges constitutes a book spine, is adhered to a book cover, consisting essentially of: (A) applying a zone of a hot melt adhesive consisting essentially of a polyurethane resin which cures by cross-linking in the presence of moisture, to a center portion of said book cover which will contact said spine, in an amount sufficient to adhere the cover to the spine; (B) applying the hot melt adhesive in two parallel strips on either side of the block of pages adjacent the spine, said strips being at least 0.5 mm wide; and (C) bringing into and maintaining said block and book cover in intimate contact while the hot melt adhesive is in a bondable condition and permitting the polyurethane resin to cure, in the presence of moisture, until adhered to each other.

15. The process of 14 wherein the adhesive of said center portion and the adhesive of said strips are of the same thickness.

16. The process of claim 14 wherein the adhesive applied to said strips.

17. The process of claim 14 wherein said parallel strips are applied through slit nozzles or perforated nozzles directly to said block, and said adhesive is applied to said center portion with the aid of a slit nozzle or a multi-hole nozzle.

* * * * *

UNITED STATES PATENT AND TRADEMARK OFFICE

CERTIFICATE OF CORRECTION

PATENT NO. : 4,984,949

DATED : January 15, 1991

INVENTOR(S) : Erich Reckziegel

It is certified that error appears in the above-identified patent and that said Letters Patent is hereby corrected as shown below:

In Claim 16, Column 6, line 18, delete "strips." and add --center portion is thicker than the adhesive applied to said strips.--

Signed and Sealed this

Twenty-first Day of July, 1992

*Attest:*

DOUGLAS B. COMER

*Attesting Officer*

*Acting Commissioner of Patents and Trademarks*